United States Patent [19]

Govan

[11] 4,447,215

[45] May 8, 1984

[54] PROPELLOR PROTECTING DEVICES

[76] Inventor: Donald T. Govan, P.O. Box 3277 Bahia Mar, Ft. Lauderdale, Fla. 33316

[21] Appl. No.: 395,859

[22] Filed: Jul. 6, 1982

[51] Int. Cl.[3] ..... B63H 5/16

[52] U.S. Cl. ..... 440/71; 440/73; 416/146 R

[58] Field of Search ..... 440/71, 72, 73; 416/146 R, 146 B; 83/673, 675, 508, 508.3, 509, 592

[56] References Cited

U.S. PATENT DOCUMENTS

| | | | |
|---|---|---|---|
| 732,568 | 6/1903 | Lee | 440/73 |
| 1,390,397 | 9/1921 | Svenson | 416/146 R |
| 1,649,657 | 11/1927 | Blake | 440/73 |
| 1,813,540 | 7/1931 | Laska | 416/146 B |
| 2,666,485 | 1/1954 | Antosh | 83/675 |
| 3,371,720 | 3/1968 | Blanchard | 416/146 B |
| 4,211,515 | 7/1980 | Henrich et al. | 416/146 R |

FOREIGN PATENT DOCUMENTS

| | | | |
|---|---|---|---|
| 15013 | of 1892 | United Kingdom | 416/146 B |
| 256544 | 4/1970 | U.S.S.R. | 416/146 B |

*Primary Examiner*—Trygve M. Blix
*Assistant Examiner*—Thomas J. Brahan
*Attorney, Agent, or Firm*—Ronald E. Smith

[57] ABSTRACT

A device that shears lines and nets of the type that can befoul propellors, propellor shafts, bearings, running gear and the like of propellor driven, sea-going vessels. A first pair of non-rotatable, diametrically opposed, radially extending cutting blade members are disposed on opposite sides of a keel, or on opposite sides of a strut that depends from the hull of an inboard motor-type boat or ship. Such blade members are provided with respective forwardly extending wedge-shaped projection portions that wedgingly engage respective rearwardly opening wedge-defining base members that are fixedly secured to opposite sides of the keel or the strut. A second pair of rotatably mounted, diametrically opposed, radially extending cutting blade members are disposed on opposite sides of a collar that is affixed to and that rotates conjointly with a propellor shaft, and such second cutting blade members cooperate with the first cutting blade members to effect a shear of troublsome lines and nets. The wedging relation between the first cutting blade members and their respective base members ensures against longitudinal separation of the first and second blade members, and the first blade members are carried by a collar that is disposed within a channel formed in the collar of the second blade members, thereby further preventing such separation and also overcoming bearing play in the shaft mechanism.

9 Claims, 13 Drawing Figures

PROPELLOR PROTECTING DEVICES

BACKGROUND OF THE INVENTION

1. Field of the Invention

This invention relates, generally, to devices that cut lines and nets of the type that befoul the propellors and associated parts of sea-going vessels, and more specifically relates to a device that is specifically designed to defeat separation of shearing blades by thick or tough lines and nets.

2. Description of the Prior Art

For a detailed description of the prior art in the general field of this invention, reference should be made to the co-pending disclosure made by the inventor herein, bearing Ser. No. 359,111, filing date: 3/17/82, entitled Propellor Protecting Device.

The above-identified disclosure by the inventor herein shows a construction that overcomes many of the limitations of earlier devices in the field of this invention. A troublesome problem occurs, however, when the propellor shaft is displaced in an axial direction, as occurs during acceleration, for example. It is important to understand that a reel-like area is defined by the rearward facing vertical surface of the strut means, the propellor shaft, and the forward facing vertical surface of the hub means at the end of the shaft which carries the propellor. The construction shown in the earlier disclosure prevents lines and nets from getting into the reel area much of the time, but accelerations and decelerations can cause the shaft to extend axially, thereby opening a space where lines and nets can enter the reel area and foul the propellors.

A need remains extant, therefore, for a construction that bars entry of lines and nets into the reel area even when the propellor shaft has been axially displaced for any reason, but the needed construction does not appear in the prior art.

SUMMARY OF THE INVENTION

The longstanding but heretofore unfulfilled need for a line and net cutting device that operates even when the propellor shaft is longitudinally extended is now fulfilled in the form of a device that has means for preventing the separation of the shearing means which accomplish the desired line and net cutting, such separation being prevented even when the shaft upon which the rotatable portion of the shearing means is mounted is axially displaced in a direction away from the stationary portion of the shearing means.

Rotatable cutting blades are carried by a collar that includes an annular channel thereabout. Non-rotatable, cooperatively positioned cutting blades are carried by a collar that is disposed within such channel. Thus, when the rotatable collar means, which is fixedly secured to and conjointly rotatable with the protected propellor shaft, is displaced in an axial direction in a rearwardly direction vis a vis the direction of boat travel, the interlocking relationship of the rotatable and non-rotatable cutting blades causes both sets of cutting blades to be displaced in an axial direction as a unit. The non-rotatable blades are further provided with forwardly extending wedge-shaped projections which mate with associated rearward-opening wedge-shaped surfaces which are defined by base members that are secured to opposite sides of the keel or strut means which stabilizes the shaft. Thus, the forwardly extending projection portions prevent the reel area from opening up at its forward end during axial displacement of the shaft. Importantly, when thick or tough lines and nets are being sheared, such lines and nets will impart forces to the stationary and rotating blades that tend to separate such blades, which separation would defeat the utility of the blades. The wedging relation of the base members and the projecting portions of the stationary blades resists the separation forces, and the amount of resistance increases responsive to increased application of separating forces, as is highly desireable.

It is therefore seen that an important object of the invention is to provide a line and net cutting device that does not lose its utility in the context of axially displaced propellor shafts.

A related object is to provide such a device having stationary and rotating blade members that are cooperatively positioned to impart a shearing force to such lines and nets, and which are interlocked so that they cannot separate.

Another closely related object is to provide a device that resists blade separation on a variable basis whereby the amount of resistance presented is directly proportional to the amount of blade-separating forces present.

The invention accordingly comprises the features of construction, combination of elements and arrangement of parts that will be exemplified in the construction hereinafter set forth, and the scope of the invention will be indicated in the claims.

BRIEF DESCRIPTION OF THE DRAWINGS

For a fuller understanding of the nature and objects of the invention, reference should be made to the following detailed description, taken in connection with the accompanying drawings, in which.

DETAILED DESCRIPTION OF THE PREFERRED EMBODIMENT

Figure 1:
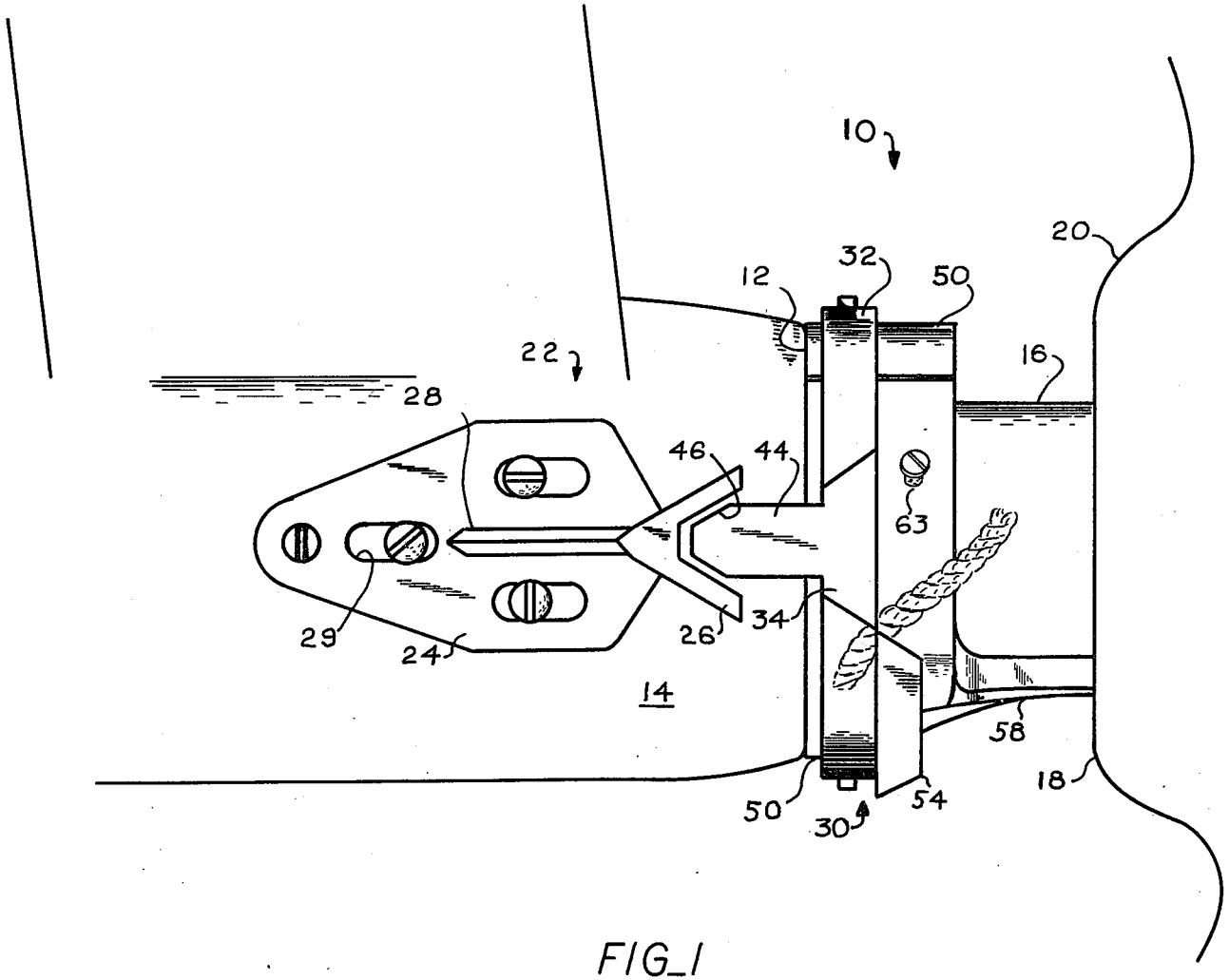
FIG. 1 is a side elevational view of an illustrative embodiment of the inventive concept, shown installed in the reel area defined by the strut, propellor shaft and hub means of a vessel.
Figure 3:
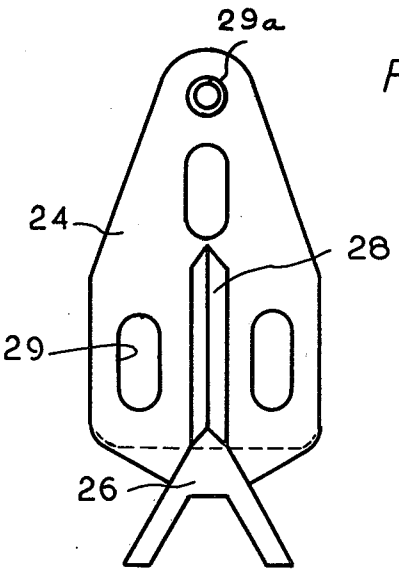
FIG. 3 is a top plan view of the base members shown in FIG. 2.
Figure 2:
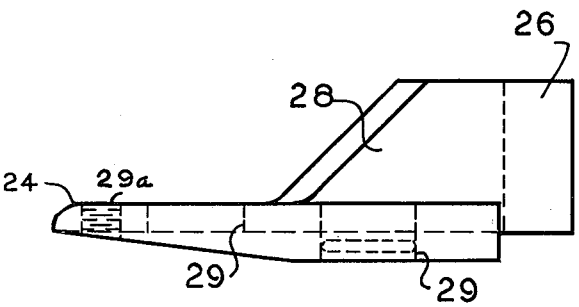
FIG. 2 is a side elevational view of the base members that are fixedly secured to opposite sides of the conventional keel or strut means.
Figure 13:
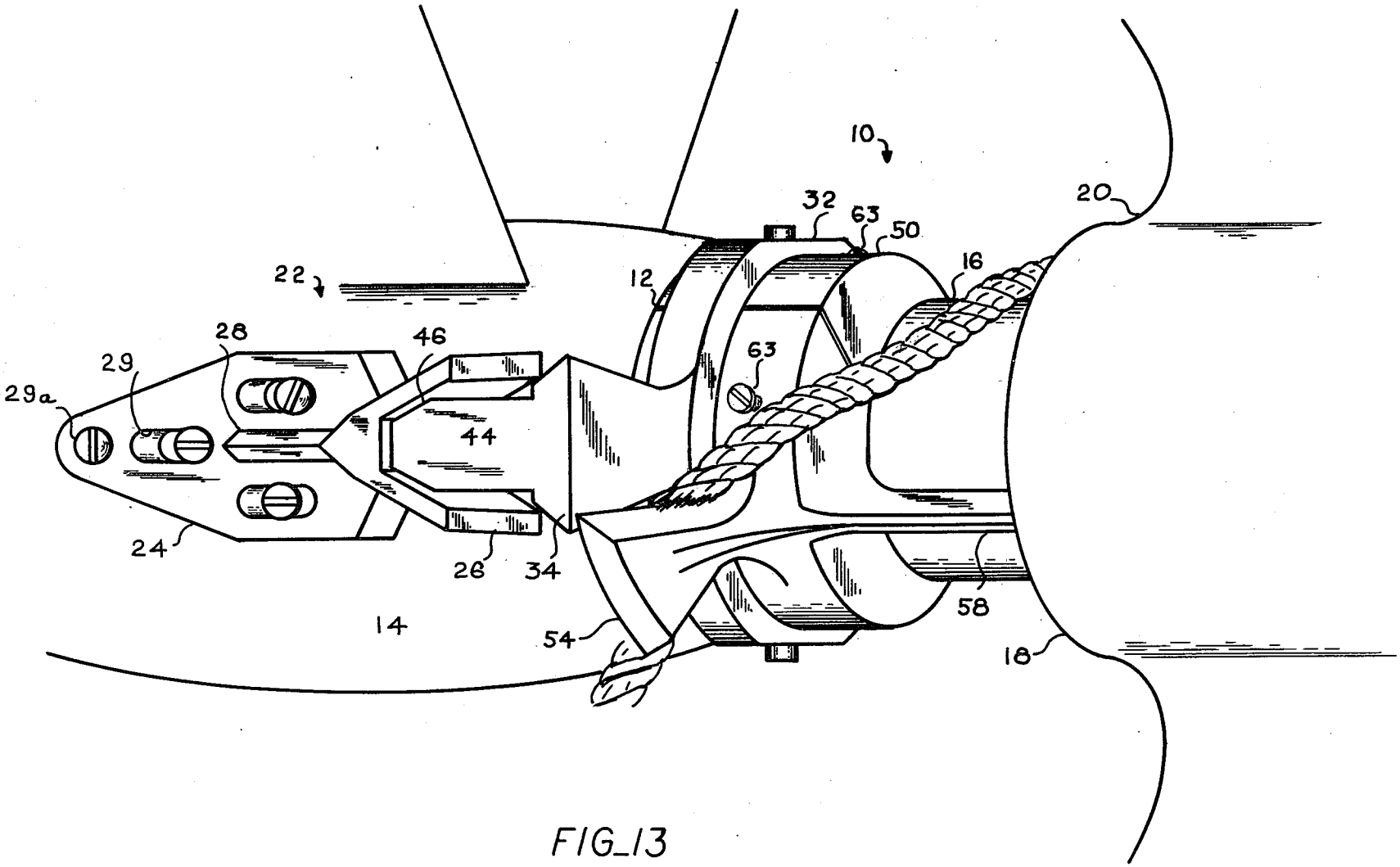
FIG. 13 is a perspective view of the inventive assembly.

Referring now to FIGS. 1 and 13, it will there be seen that the preferred embodiment of the invention is generally indicated as 10. The assembly is disposed in a reel area defined by the rearward facing, vertially disposed surface 12 of a shaft-stabilizing strut means 14, the propellor shaft 16 and the forward facing, vertically disposed surface 18 of a hub means 20.

A pair of base members 22, 22, only one of which is shown in FIGS. 1 and 13, are fixedly secured in diametrically opposed relation to one another on opposite sides of the strut means 14. Each base member 22, 22 includes a base plate portion 24, a rearwardly wedge portion 26, and an inclined support wall or web 28. The respective base plate portions 24 are perforated as shown at 29 to allow longitudinal adjustment of such base members 22, 22 relative to the sidewalls of the strut means 14. (Of course, in vessels having no strut means, the base members 22 are affixed to opposite sides of the keel). Another perforation or screw-receiving aperture is indicated as *29a*. Axial adjustment of a screw means extending through the aperture *29a* will result in pivoting of the respective base members 22, 22 in a horizontal plane so that each respective rearwardly opening wedge portion 26, 26 can be adjusted to squarely mate with a complementally formed, cooperatively positioned, forwardly projecting wedge shaped portion to be described hereinafter. FIGS. 2, 3, 10 and 11 should be viewed in conjunction with FIG. 1.

Figure 6:
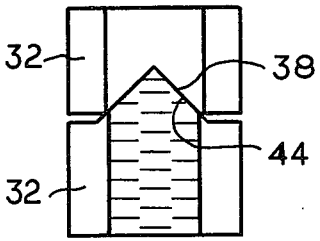
FIG. 6 is a cross sectional view taken along line 6—6 of FIG. 4.
Figure 5:
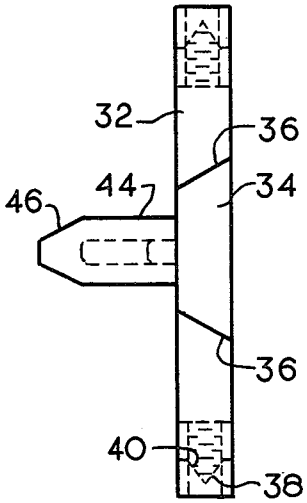
FIG. 5 is a side elevational view of the shearing means shown in FIG. 4.
Figure 4:
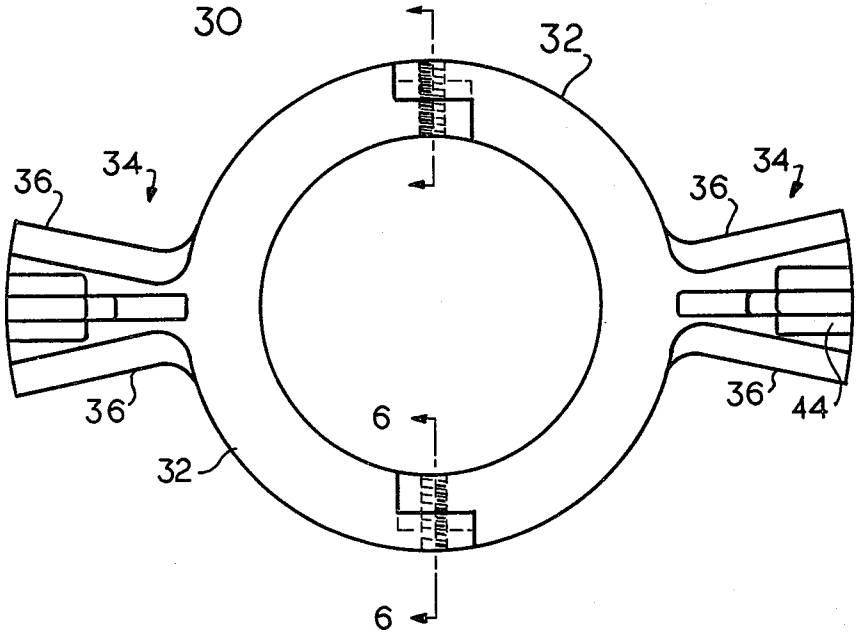
FIG. 4 is a top plan view of the non-rotating shearing means.
Figure 12:
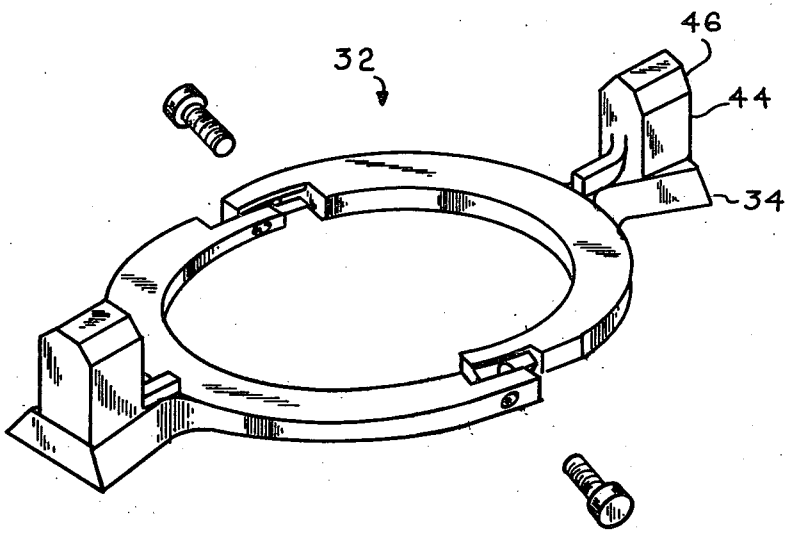
FIG 12 is a perspective view of the non-rotating shearing means.

The stationary, or non-rotatable shearing means is indicated generally by the reference numeral 30, is best seen in FIGS 4, 5 and 12, and includes a bifurcated collar means 32 having a generally square cross section. Fan shaped, or dove tailed, cutting blade members 34, 34 extend radially from the collar means 32, and include cutting edges 36, 36. The blades 34, 34 lie in a plane orthogonal to the axis of rotation of the propellor shaft 16. The bifurcated structure of the collar 32 permits its attachment to the shaft 16 in the absence of a need to remove the propellor and propellor hub means 20. As shown best in FIG. 6, a "V"-shaped projection 38 and complementally formed "V"-shaped recess 40 are formed in the engaging portions of the collar halves 32, 32 as shown to enhance the interlocking of the two (2) halves to thereby better resist shearing forces imparted to the collar means 32.

A forward projecting arm 44, best seen in FIGS. 1, 5 and 12, is integrally formed with each cutting blade member 34, 34. Each arm 44, 44 is disposed parallel to the axis of rotation of the propellor sharft 16 and terminates in a wedge-shaped portion 46. The respective wedge-shaped portions 46, 46 mate with the associated wedge-shaped openings 26, 26 of the base members 22, 22, as shown best in FIG. 1. The portions 46 and 26 are specifically dimensioned and configured so that when increasing amounts of external force are imparted to cause convergence of such portions, the amount of resistance to such convergence will increase by a corresponding amount. The materials with which the inventive parts are formed, disclosed hereinafter, prevent any locking of the portions 46 and 26.

Figure 8:
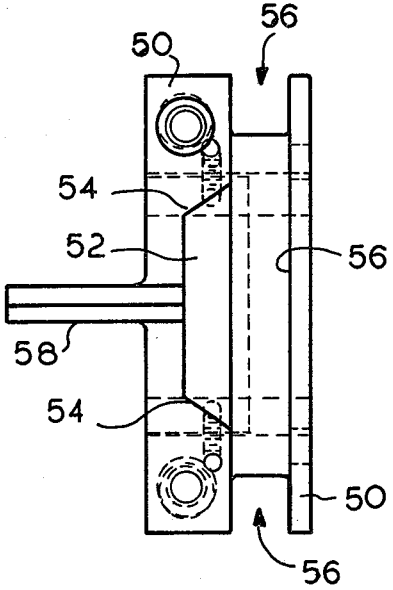
FIG. 8 is a side elevational view of the shearing means depicted in FIG. 7.
Figure 7:
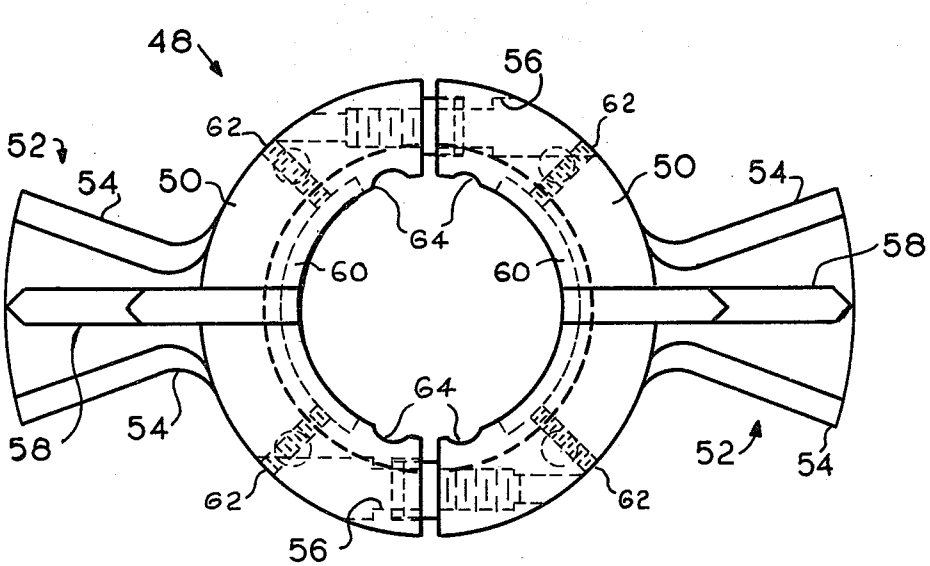
FIG. 7 is a top plan view of the rotatable shearing means.
Figure 10:
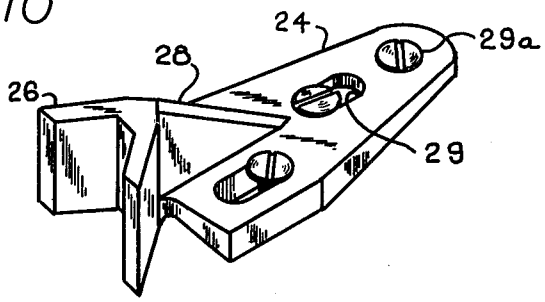
FIG. 10 is a perspective view of the base member shown in FIGS. 2 and 3.
Figure 9:
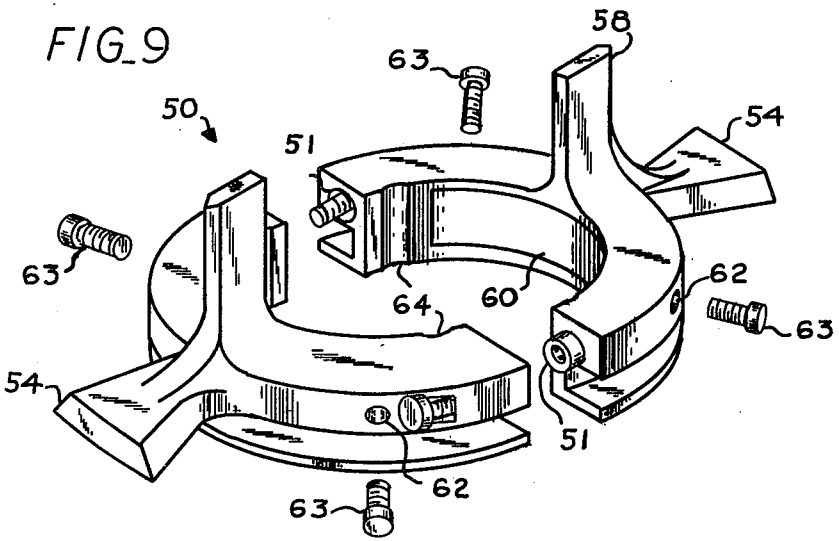
FIG. 9 is a perspective view of the rotatable shearing means.
Figure 11:
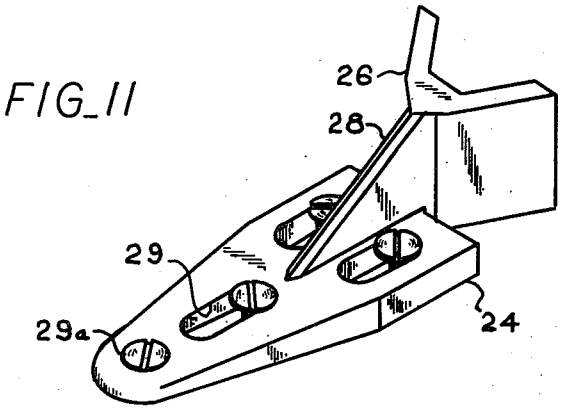
FIG. 11 is another perspective view of the part shown in FIGS. 2, 3, and 10.

Attention should now be directed to FIGS. 7, 8 and 9, wherein the rotatably mounted shearing means, designated 48 as a whole, is shown. The shearing means 48 is of bifurcated construction, having halve portions 50, 50 to facilitate its attachment to a propellor shaft 16. A pair of fan-shaped cutting blade members 52, 52 having cutting edges 54, 54 extend radially from the halve portions 50, 50, in diametrically opposed relation to one another. Countersunk bores 56, 56 are formed in the respective halve portions 50, 50 as shown to receive associated screw means-not shown-to unite the halves 50, 50 to form a collar means about the propellor shaft 16. The half portions 50, 50 are also keyed as at 51, 51 to aid assembly thereof and to resist shearing forces or other forces imparted thereagainst that could possibly cause relative movement between such halve portions 50, 50 in the absence of such keying means 51, 51.

As best seen in FIGS. 8 and 9, an annular channel is formed in each half portion 50, 50 so that a continuous square-in-section annular channel 56 is provided when the halve portions 50, 50 are united to provide a collar means as aforesaid. The non-rotatable collar means 32, 32 which carry stationary cutting blade members 34, 34 is slideably received within the annular channel 56, as is clear from FIGS. 1 and 13. Again, the materials with which the inventive parts are formed, disclosed hereinafter, provide for easy, low friction relative movement between the rotating shearing means 48 and the non-rotating shearing means 30. Clearly, the slideable mounting of the stationary shearing means 30 within the annular channel 56 of the rotating shearing means 48 brings the non-rotatable cutting blade members 34, 34 and the rotating cutting blade members 52, 52 into line and net cutting relation to one another each rotation of the propellor shaft 16.

Each rotatable cutting blade member 52, 52 is provided with a rearwardly extending arm 58 that is disposed parallel to the axis of rotation of the propellor shaft 16. The arms 58, 58 are integrally formed with the blades 52, 52 and abut the hub means surface 18 which also rotates conjointly with the shaft 16. Thus, the reel area described above is "full", and lines and nets cannot enter thereinto.

The provision of annular channel 56 in the rotatable shearing means 48 will cause the non-rotatable shearing means 30 to be displaced with the rotatable shearing means 48", thereby avoiding any separation of the rotating and non-rotating blades. When a thick or tough line or net is being sheared, the interlocking of such moving and stationary blades that is provided by the annular channel 56 also serves to prevent separation of the cooperatively positioned cutting blades. The wedging back-up of the stationary blades 34, 34 further prevents such separation, the wedging relation between the blades 34, 34 and the base members 22, 22 serving to defeat separation forces of differing amounts, as aforesaid. Moreover, the interlocking nature of the inventive parts also serves to prevent wobbling motion of the shaft 16, such wobbling motion generally referred to in the boating industry as "bearing play".

Many propellor shafts are tapered, and means must therefore be provided to allow the rotating collar means 48 to seat against such shafts. The preferred means take the form of a pair of semi-circular plates 60, 60 (FIG. 7) that are disposed on opposite sides of the shaft 16, in sandwiched relation between such shaft and the collar means 48. A plurality of preferably four (4) equidistantly and circumferentially spaced, radially aligned bore means 62, 62, 62, 62 are formed in the collar 48, at ninety (90) degree intervals as shown (each bore 62 being inclined 45 degrees from the axis of rotation of the shaft 16). Set screws extending through such bores 62 are then selectively adjusted to seat such plates 60, 60 against the tapered shaft.

The circumferentially spaced dished portions formed in the collar means 48 and designated collectively as 64, and serve to permit the flow of water therethrough. (The bearings associated with the shaft 16 are cooled by such water, and such dished portions 64 permit water that has performed its cooling function to be "exhausted" without interference from the inventive assembly).

The preferred materials with which the novel apparatus is formed is 420 stainless steel, (to resist corrosion), electroplated with Nickle and Boron to provide a 75 Rockwell hardness, and impregnated with Teflon (Trademark) to provide a smooth, low friction surface. Those skilled in the art of metallurgy will be cognizant of other suitable materials with which the inventive apparatus could be formed, and those skilled in the art of machine design, now that the invention has been shown and described, will be cognizant of numerous forms of structure within which the invention could reside, such alternate forms clearly being within the scope of the invention. A synergistic effect occurs as a result of the electroplating called for herein-the rotating and non-rotating parts of the novel assembly are given a like magnetic charge as a result of such electroplating process. The resulting repulsion lowers the friction between such parts by a substantial, significant amount, thereby reducing the load on the vessel's engine and extending the service life of the inventive assembly.

It will thus be seen that the objects set forth above, and those made apparent by the preceding description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

That which is claimed is:

1. A device for cutting lines and nets, that float on the surface of water and lines and nets that are disposed in substantially upstanding relation beneath the surface of water, so that such lines and nets do not foul the propellers, shafts, and bearings of propeller driven vessels, comprising, in combination, a base means defined by a pair of diametrically opposed base members that are fixedly secured to a keel of a vessel, said base members having a rearward opening wedge-shaped portion, an annular, non-rotatable first shearing means adapted for mounting about a propeller shaft means, said first shearing means having diametrically opposed first cutting blade members disposed in registration with said diametrically opposed base members, said first cutting blade members having a forward extending wedge-shaped portion adapted for wedging engagement with the rearward opening wedge-shaped portion of said base members, an annular, rotatable second shearing means fixedly secured to and conjointly rotatable with said propeller shaft, having diametrically opposed second cutting blade members disposed in cooperative relation to said first cutting blade members so that lines and nets are sheared by said first and second shearing means attendant rotation of said second shearing means relative to said first shearing means, longitudinal separation of said first and second shearing members being substantially prevented by the wedging relationship between said base members and said first shearing means, said second shearing means further comprising an annular, square-in-section channel means within which said first shearing means is rotatably mounted, said channel serving to prevent longitudinal separation of said first and second shearing means.

2. The device of claim 1, wherein said first shearing means comprises a symmetrically bifurcated collar means, said diametrically opposed first blade members associated with different ones of said bifurcated collar means and extending radially therefrom, aligned in a vertical plane.

3. The device of claim 2, wherein said second shearing means further comprises a symmetrically bifurcated collar means, said diametrically opposed second blade members associated with different ones of said bifurcated collar means and extending radially therefrom, aligned in a vertical plane.

4. The device of claim 3, wherein said first and second cutting blade members respectively comprise fan-shaped shearing members, each of which has a leading edge and a trailing edge, and wherein both of said leading and trailing edges are provided with cutting surfaces so that said second shearing means functions independently of the angular direction of propeller shaft rotation.

5. The device of claim 4, wherein said second shearing means further comprises a pair of longitudinally aligned, rearwardly extending, diametrically opposed spacer members the respective distal ends of which abut a hub means which carries a propeller means so that said lines and nets are barred from wrapping around the propeller shaft by said spacer means.

6. The device of claim 5, wherein said base members are integrally formed with respective base plate members which are fixedly secured to diametrically opposed sides of said keel, said base plate members adapted for longitudinally adjustable mounting so that the tolerance between said first and second shearing means can be adjusted.

7. The device of claim 6, wherein the respective base plate members are adapted for pivoting in a horizontal plane so that said rearward opening wedge-shaped portions are movable in a horizontal plane so that such wedge-shaped portions can mate squarely with said forward extending wedge-shaped portions of said non-rotating first shearing means.

8. The device of claim 7, wherein said collar means of said rotating second shearing means is provided with a plurality of circumferentially spaced, radially aligned bore members through which extend set screw means individual to each bore member, and wherein a pair of diametrically opposed plate members of semi-circular configuration are disposed in sandwiched relation between said collar means and said propeller shaft so that selective adjustment of said set screws effects centering of said arcuate plate members against said shaft whether said shaft is uniform in diameter along its length or whether said shaft has a taper along its length.

9. The device of claim 8, wherein said rotating and non-rotating shearing means are provided with a like magnetic charge so that the mutual repulsion thereby generated will reduce the amount of friction that attends the relative motion therebetween.

* * * * *